US006593892B2

(12) United States Patent
Honda et al.

(10) Patent No.: US 6,593,892 B2
(45) Date of Patent: Jul. 15, 2003

(54) COLLINEAR COAXIAL SLOT-FED-BICONICAL ARRAY ANTENNA

(75) Inventors: Royden M. Honda, San José , CA (US); Court E. Rossman, Prunedale, CA (US)

(73) Assignee: Tyco Electronics Logistics AG (CH)

( * ) Notice: Subject to any disclaimer, the term of this patent is extended or adjusted under 35 U.S.C. 154(b) by 0 days.

(21) Appl. No.: 09/898,611

(22) Filed: Jul. 3, 2001

(65) Prior Publication Data

US 2003/0085845 A1 May 8, 2003

(51) Int. Cl.[7] ..... H01Q 13/00
(52) U.S. Cl. ..... 343/773; 343/774; 343/893
(58) Field of Search ..... 343/756, 761, 343/773, 774, 872, 893, 853, 844

(56) References Cited

U.S. PATENT DOCUMENTS

| | | | | |
|---|---|---|---|---|
| 2,471,021 A | | 5/1949 | Bradley | 178/44 |
| 2,726,388 A | | 12/1955 | Kandoian et al. | 343/774 |
| 2,866,194 A | | 12/1958 | Stavis | 343/725 |
| 3,159,838 A | | 12/1964 | Faccine | 343/792 |
| 3,795,914 A | * | 3/1974 | Pickles | 343/756 |
| 3,829,863 A | | 8/1974 | Lipsky | 343/773 |
| 4,461,039 A | | 7/1984 | Hersman | 455/326 |
| 4,700,196 A | | 10/1987 | Campbell et al. | 343/797 |
| 4,719,699 A | | 1/1988 | Dash et al. | 30/90.1 |
| 4,835,542 A | | 5/1989 | Sikina, Jr. | 343/802 |
| 4,851,859 A | | 7/1989 | Rappaport | 343/790 |
| 5,367,312 A | | 11/1994 | Masters | 343/807 |
| 5,534,880 A | | 7/1996 | Button et al. | 343/774 |
| 5,767,814 A | * | 6/1998 | Conroy et al. | 343/774 |
| 5,923,299 A | | 7/1999 | Brown | 343/773 |
| 6,154,182 A | | 11/2000 | McClean | 343/773 |

OTHER PUBLICATIONS

Henry Jasik, Antenna Engineering Handbook, 1961, p. 26–2 and 22–8.

* cited by examiner

*Primary Examiner*—James Clinger
(74) *Attorney, Agent, or Firm*—Fulbright & Jaworski L.L.P.

(57) ABSTRACT

The present invention comprises a substantially omnidirectional antenna with minimal gain variation over the 360 degree azimuth. A plurality of biconical antenna elements are stacked, wherein a feed line passes through the center of the biconical antenna elements. The feed line is designed to provide the proper quantity of power to each biconical antenna element without the use of a power divider. Each biconical antenna element is formed by two truncated flared apart reflecting surfaces. Each biconical antenna element is attached to a nonconductive collar above and below.

17 Claims, 10 Drawing Sheets

FIG. 8 Evaluation Pattern
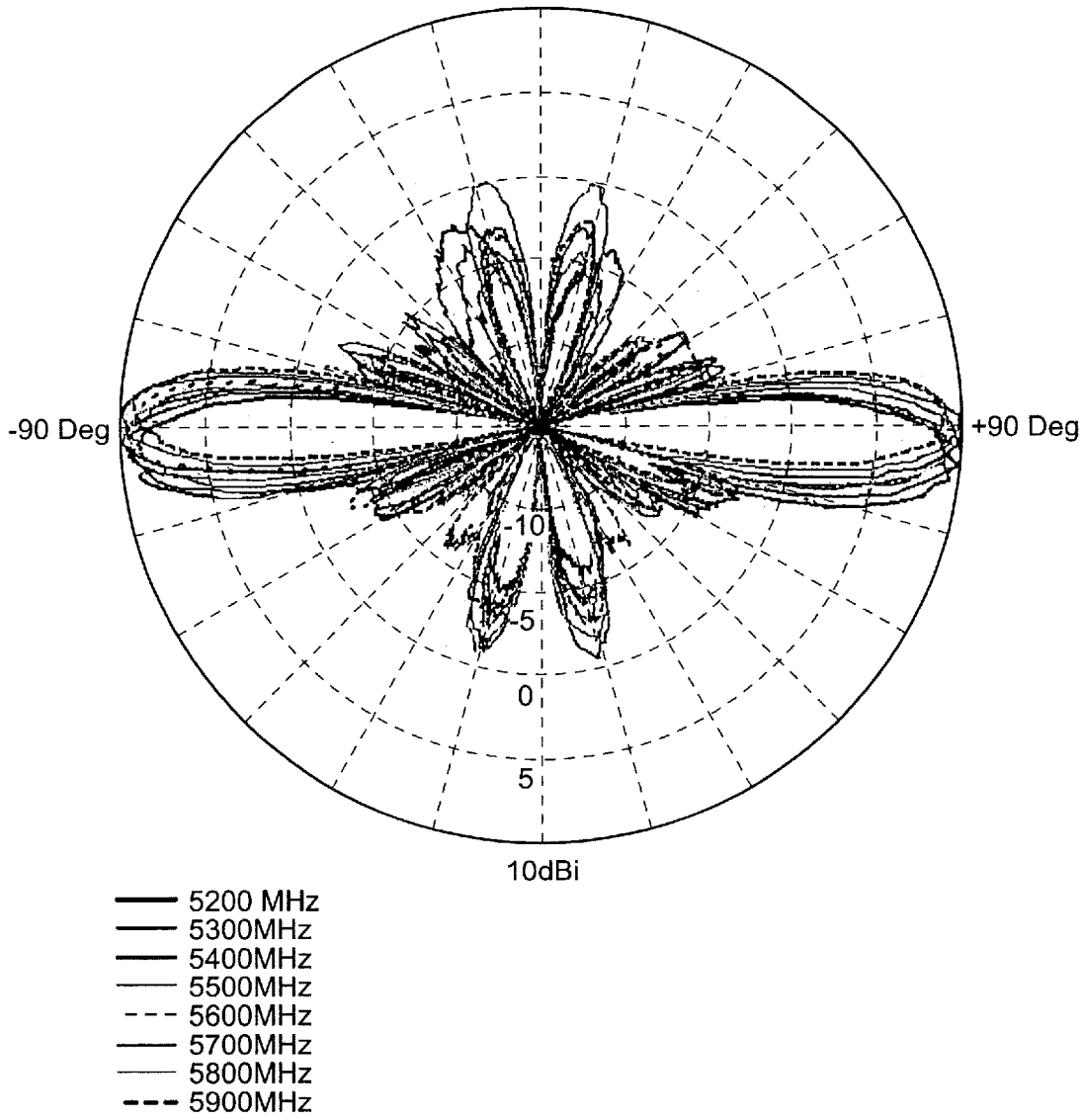

FIG. 9 Azimuth Pattern
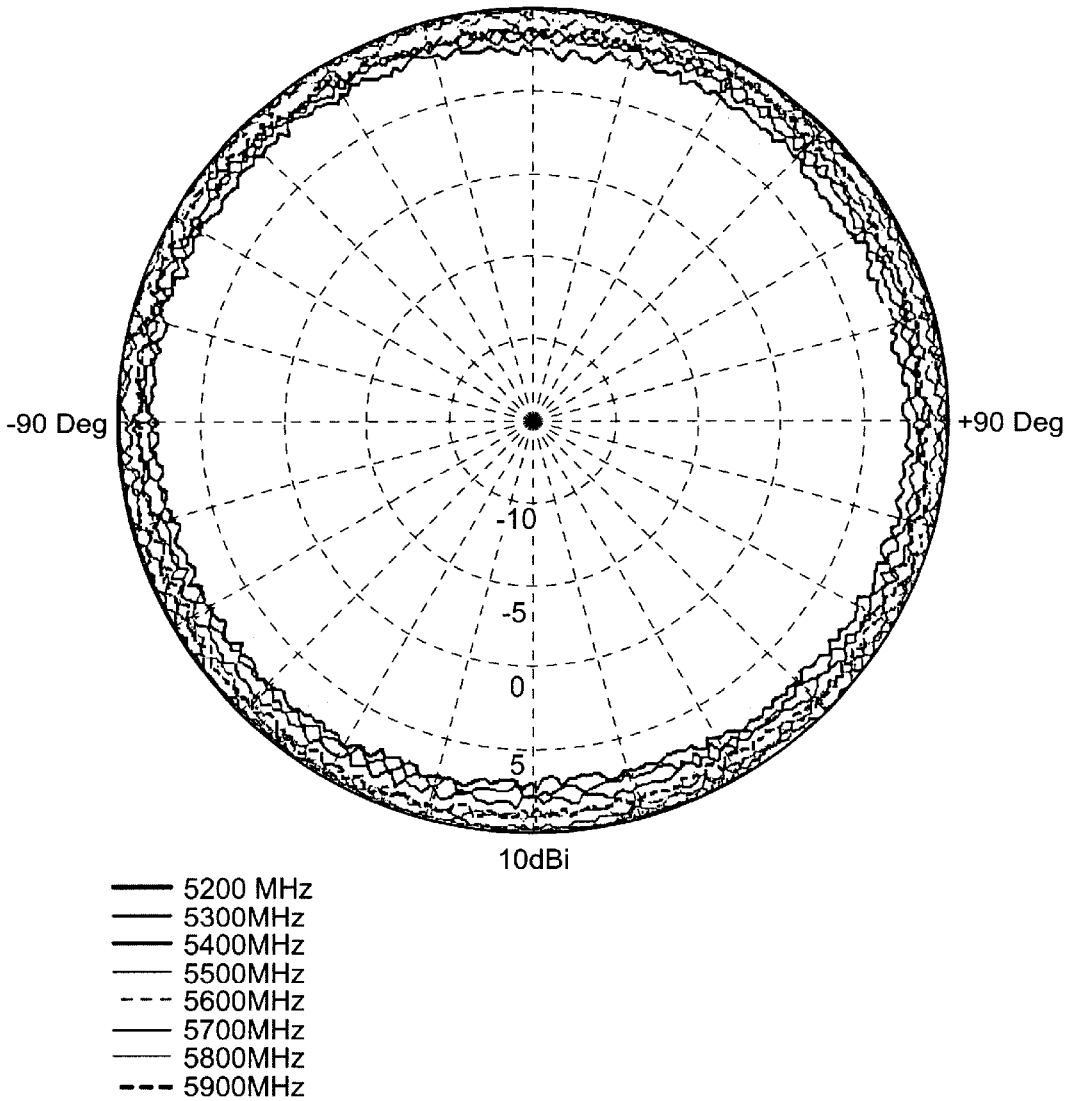

FIG. 10 VSWR Plot
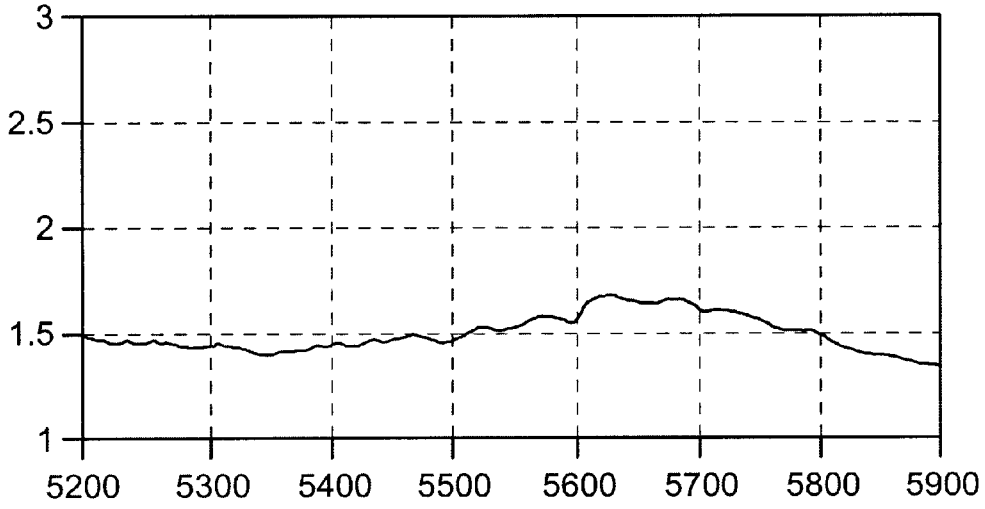

FIG. 11 Evaluation Pattern
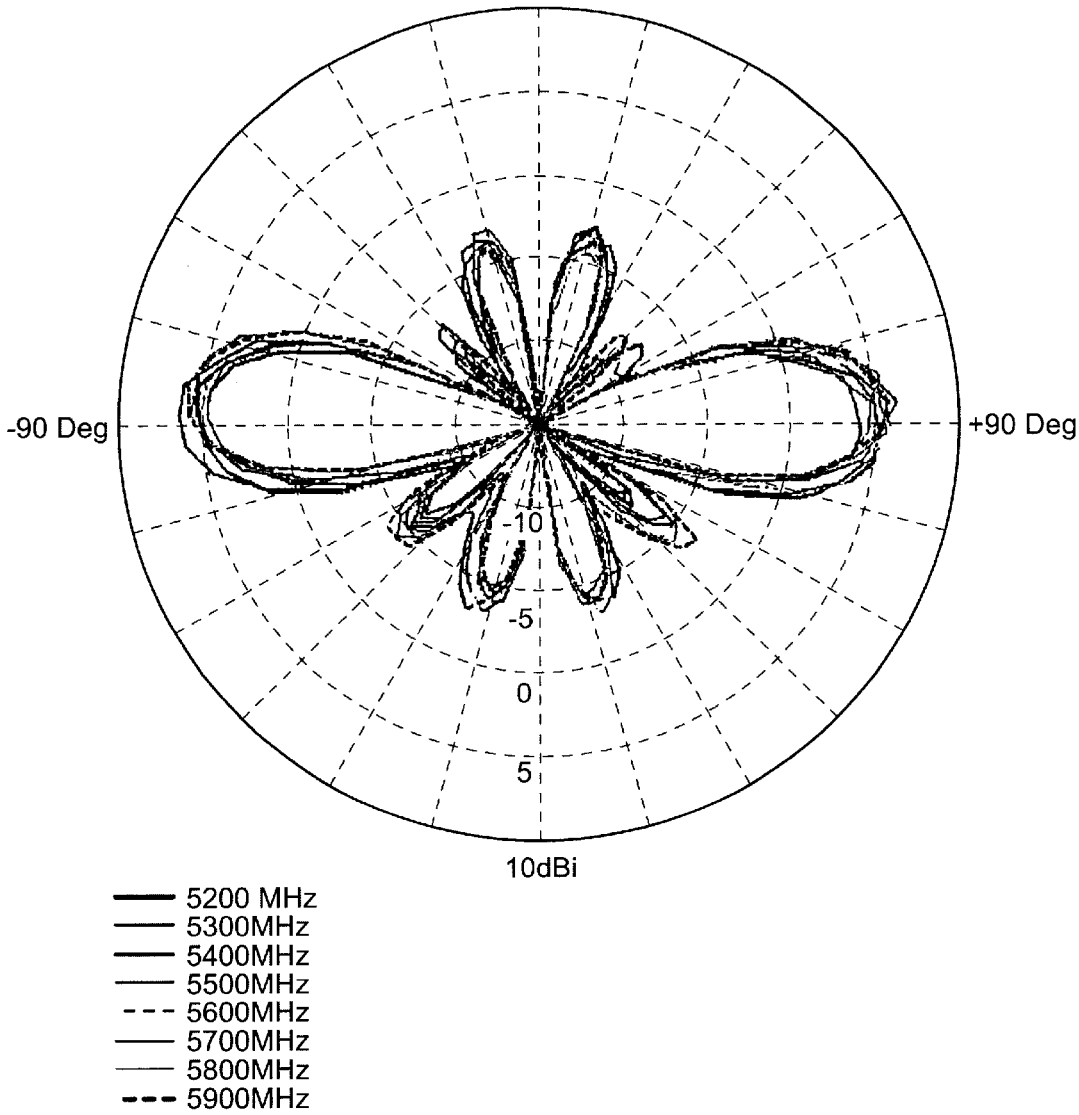

FIG. 12 VSWR Plot
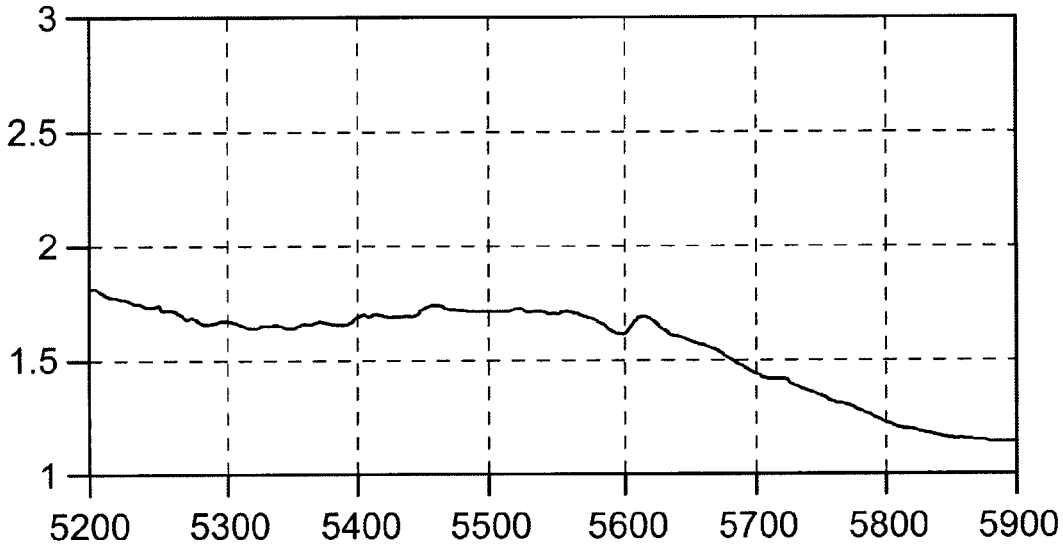

COLLINEAR COAXIAL SLOT-FED-BICONICAL ARRAY ANTENNA

FIELD OF INVENTION

The present invention relates to substantially omnidirectional antennas, particularly a stacked biconical antenna.

BACKGROUND OF INVENTION

The present invention relates to substantially omnidirectional antennas, particularly stacked biconical antennas.

Biconical antennas have commonly been used for their omnidirectional characteristics in azimuth. It has been discovered that for any given desired gain, the volume for a biconical antenna can be reduced by replacing a single biconical with a stacked array of a plurality of biconical antenna elements. Several examples of stacked biconical antennas are discussed below.

U.S. Pat. No. 3,159,838 (Facchine) discloses a single biconical antenna with a coaxial feed cable. This and all other patents cited herein are hereby specifically incorporated herein by reference in their entirety. Attached to the feed cable are smaller cables that bring electromagnetic energy to the biconical antenna. The feed point is close to the main cable since otherwise there may be interference from the smaller feed cable.

U.S. Pat. No. 5,534,880 (Button) discloses a stack of biconical antennas in which a radome supports the structure of the antenna. A transmission wire bundle is helically spiraled within the radome to provide electromagnetic energy to the biconical antenna elements. Separate transmission wires emanate from the main transmission wire bundle and connect directly to the radiating elements to provide energy to each biconical antenna element.

The shortcomings of the prior art are twofold. First, the wiring required to provide energy to the antenna induces interference with the outgoing signal, distorts the omnidirectional radiation pattern, induces interference with the incoming signal, and requires the use of a power divider. Second, the structure of some of the antennas necessitates a radome to support the structure of the antenna. It has also been found that the simpler mechanical design of the present invention leads to an antenna with a more rugged and robust performance.

SUMMARY OF THE INVENTION

The present invention is directed to a substantially omnidirectional antenna comprising a plurality of stacked biconical antenna elements, wherein each of the biconical antenna elements is formed by a two truncated flared apart conductive cones with a bore perpendicular to the base of each cones. The antenna also comprises a plurality of nonconductive collars between adjacent cones. Further the antenna comprises a single feed line which passes through the biconical antenna elements and the nonconductive collars. The feed is in one of many possible configurations. One advantage of the device is its flexibility in that the feed's characteristics determines the amount of energy released by each particular biconical antenna element. The antenna also allows the energy to be controlled and balanced in order to transmit a substantially uniform signal. Further, other parameters of the device also may be manipulated to change the amount of energy released by each biconical antenna element. Another advantage of the device is that the inner conductor is not in contact with the biconical antenna elements, allowing for a simpler mechanical design. In another embodiment, the substantially omnidirectional antenna of the present invention advantageously provides a gain of 8–10 dB that is maintained nearly identically over the entire 360 degree azimuth range.

The present invention is also directed to a method for sending a substantially omnidirectional wireless communication signal via an antenna. The communication signal is created by passing a feed line through the center of a plurality of biconical antenna elements and sending electromagnetic current through the feed line.

The present invention is also directed to a feed line for a substantially omnidirectional biconical array antenna. The feed line may be a tapered serial coaxial cable engineered to deliver the required energy to each element of the antenna. The feed line may also be a parallel coaxial cable engineered to deliver the required energy to each element of the antenna.

The present invention is also directed to a method of connecting an array of biconical antenna elements. The antenna is connected by stacking a plurality of biconical antenna elements, placing a nonconductive collar within each biconical antenna element, passing a rigid structure through the center of said biconical antenna elements and collars, and securing structure together by squeezing said biconical antenna elements and said nonconductive collars.

Other objects and advantages of the present invention will become apparent during the description of the several preferred embodiment of the invention taken in conjunction with the drawings.

BRIEF DESCRIPTION OF THE DRAWINGS

FIG. 8 is the elevation pattern for a 4-element biconical antenna.

FIG. 9 is the azimuth pattern for a 4-element biconical antenna.

FIG. 10 is the VSWR pattern for a 4-element biconical antenna.

FIG. 11 is the elevation pattern for a 2-element biconical antenna.

FIG. 12 is the VSWR pattern for a 2-element biconical antenna.

DETAILED DESCRIPTION OF THE PREFERRED EMBODIMENTS

Figure 1:
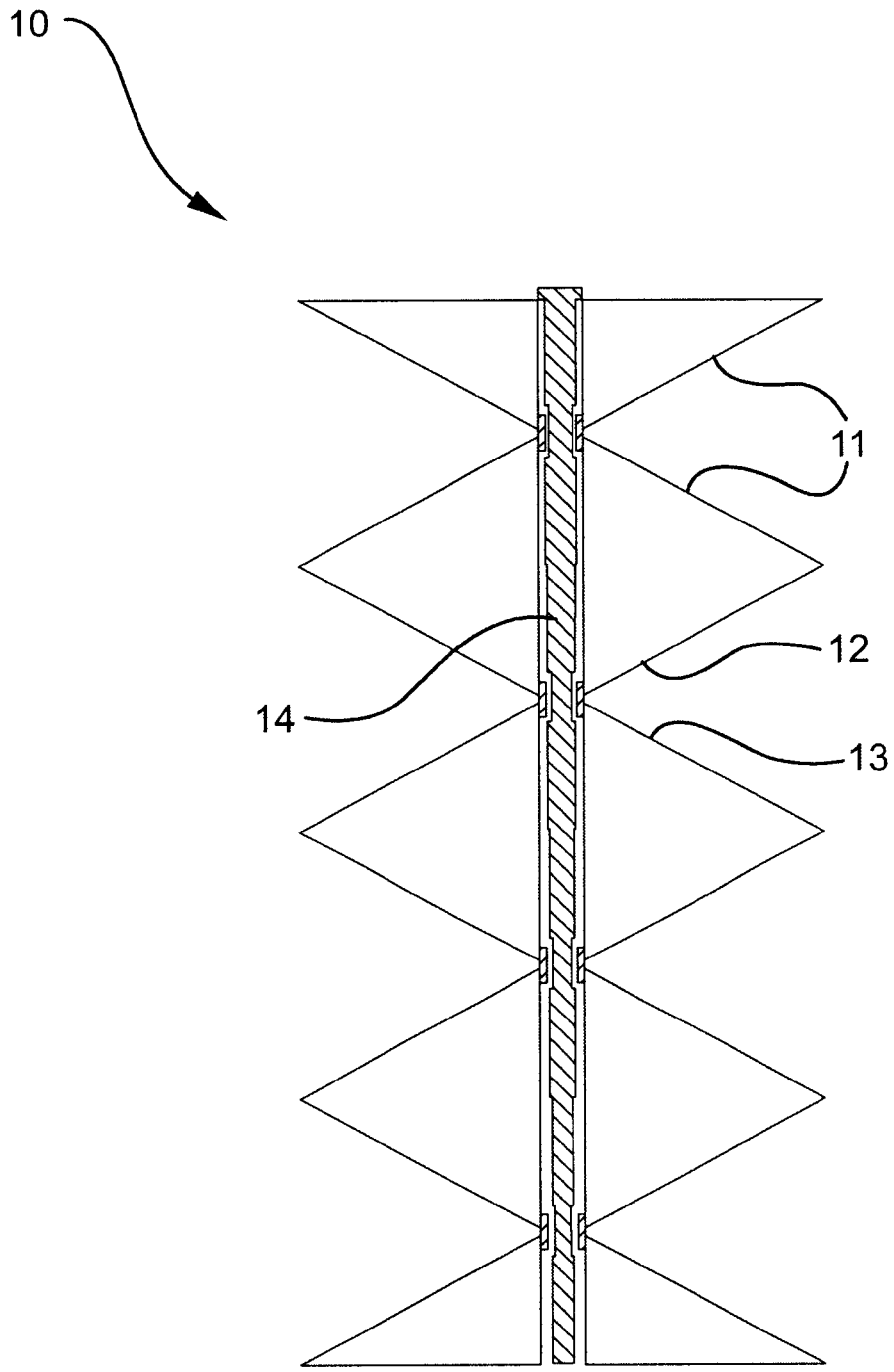
FIG. 1 is a side view of the stacked substantially omnidirectional antenna, this particular embodiment includes four biconical array elements and a serial feed line.
Figure 2:
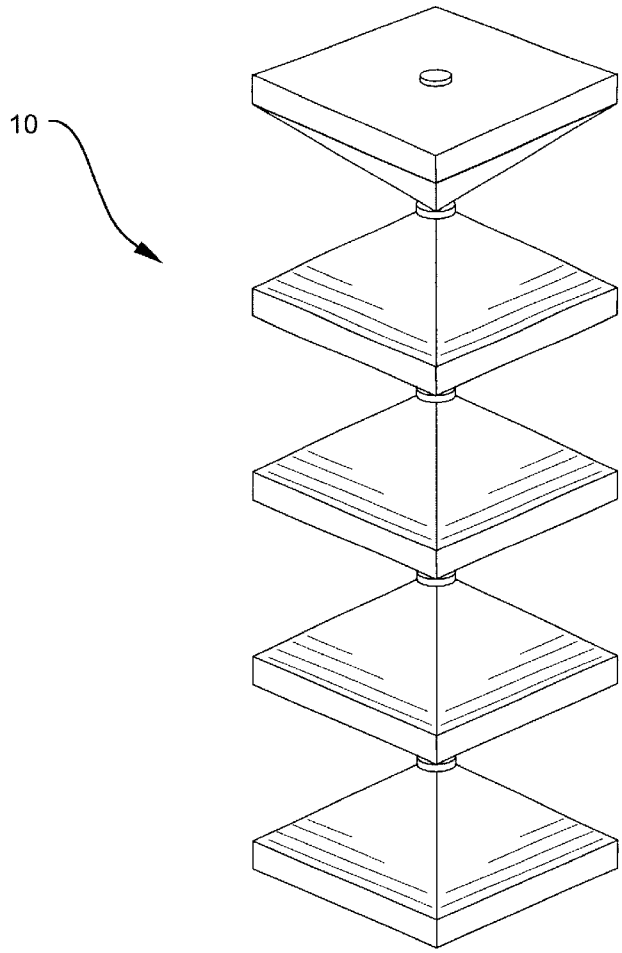
FIG. 2 is a skewed side view of the stacked substantially omnidirectional antenna, this particular embodiment includes four biconical array elements and a serial feed line.
Figure 3:
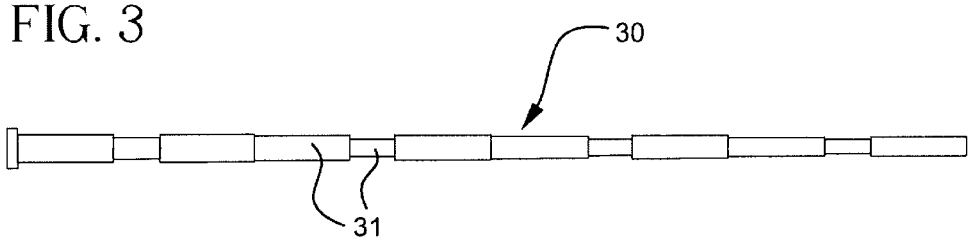
FIG. 3 is a side view of a serial coaxial center conductor.

Referring now to the drawings, the construction of a substantially omnidirectional antenna of the present invention is illustrated. The substantially omnidirectional antenna 10 is created with a plurality of n biconical antenna elements 11. The illustrated antenna embodiment 10 includes a stack of four biconical antenna elements. In one embodiment the biconical antenna elements are made of brass. In other embodiments, any conductive material such as, but not limited to, aluminum and tin-plated steel may be used to construct the biconical antenna element's plated conductive surface over dielectric. Each biconical antenna element is formed by a pair of truncated flared apart conductive surfaces. The pair of truncated flared apart surfaces are connected together, by any suitable means, preferably by soldering, but may be connected through other connective means as well. Each flared apart surface may be manufactured by spun metal or stamping techniques. Holes 14, horizontal to the plain of the biconical antenna element are also made entirely through the biconical antenna element.

In one embodiment, the biconical antenna connector (collar) 70 is manufactured from an ABS (acrylonitrile-butadiene-styrene) material, but may be constructed from any other non-conductive material such as plastic. Each collar is connected above 12 and below 13 to a biconical antenna segment. The method of connection is preferably a connective force supplied by the connection of the feed line to the antenna structure. In one embodiment the antenna is bolted at the top and bottom to hold the bicones and collars firmly together. The collars advantageously provide mechanical support to the biconical antenna array. The collars also create the aperture from which the electromagnetic energy from the feed line 30 is emitted from the biconical antenna elements 11. Holes 61, horizontal to the plane of the collar, are also made entirely through the collar.

In one embodiment, the inner conductor 30 is brass, but can be constructed of any conductive material, such as but not limited to, brass, aluminum or tin-plated steel. In one embodiment the feed system is in a series configuration with varying tapered diameters 31. Other designs for the feed system are also possible including a parallel design 40. A serial feed may be constructed to emit approximately 1/n of the total electromagnetic energy at each biconical antenna element. This is achieved by providing a specific diameter 31 at each point along the length of the inner or outer conductor of the feed. Dimensions of such a tapered serial feed are given in the illustrated embodiment. For other embodiments, one skilled in the art, with a reasonable amount of experimentation, may ascertain proper taper dimensions. The illustrated resultant tapered series feed configuration provides for a substantially uniform level of radiation transmitted by each biconical element. Another embodiment provides an altered beam shape by adjusting the inner or outer conductor's diameters. The feed is preferably attached to a connector 70. The connector is then attached to the center 71 of the top of the uppermost biconical antenna. The feed is placed through the biconical antennas and collars. The advantage of the inventive connector is that it provides support for the feed, and preferably keeps the center feed centered within, but not in contact with, the biconical antenna elements and collars. The feed can be bolted, welded, soldered, or otherwise secured in place on top 15 and bottom 16 to ensure stability of the antenna.

In the illustrated embodiment the antenna contains four biconical array elements. FIG. 8 shows the elevation pattern for a 4-element biconical antenna. FIG. 9 shows the azimuth pattern for a 4-element biconical antenna. FIG. 10 shows the VSWR pattern for a 4-element biconical antenna. Another embodiment of the antenna provides for two biconical array elements. FIG. 11 shows the elevation pattern for a 2-element biconical antenna. FIG. 12 shows the VSWR pattern for a 2-element biconical antenna. As can be seen from the FIGS. 8–12 an antenna with more biconical array elements provides a larger gain in the horizontal direction and also provides a narrower beam.

In another embodiment, a serial feed can employ a continuous taper, this providing the advantage of simple machining and low cost of manufacture.

In another embodiment, the height of the slot apertures can be varied in lieu of altering the inner conductor to control the amount of energy emitted through each slot. In this manner, the height of the slot apertures additionally controls the amount of energy radiated from each biconical antenna element. This provides an advantage of allowing the use of a uniform-diameter feed. Further altering the slots' heights alters the emitted beam characteristics. Larger slots provide a higher directional gain and reduced side-lobes in the antenna signal pattern. The affects of altering the height of the slot aperture can also be accomplished through altering the flare angles of the biconical array elements.

Figure 4:
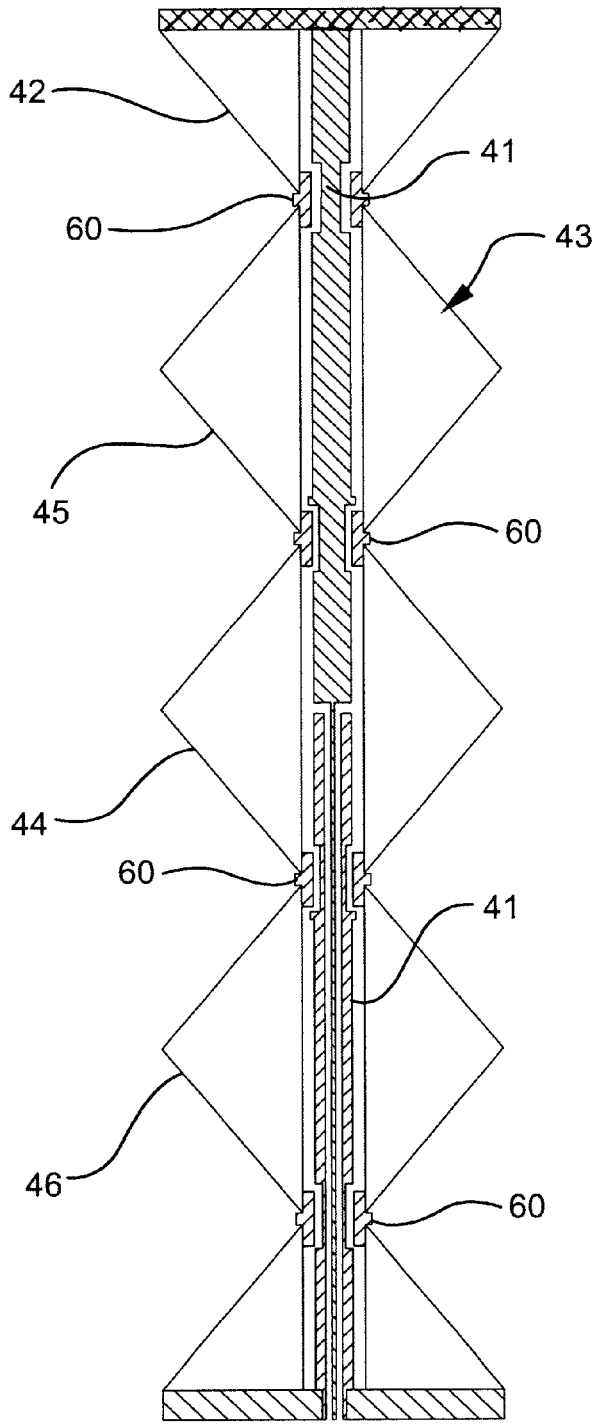
FIG. 4 is a side view of the stacked substantially omnidirectional antenna, this particular embodiment includes four biconical array elements and a serial feed line.
Figure 5:
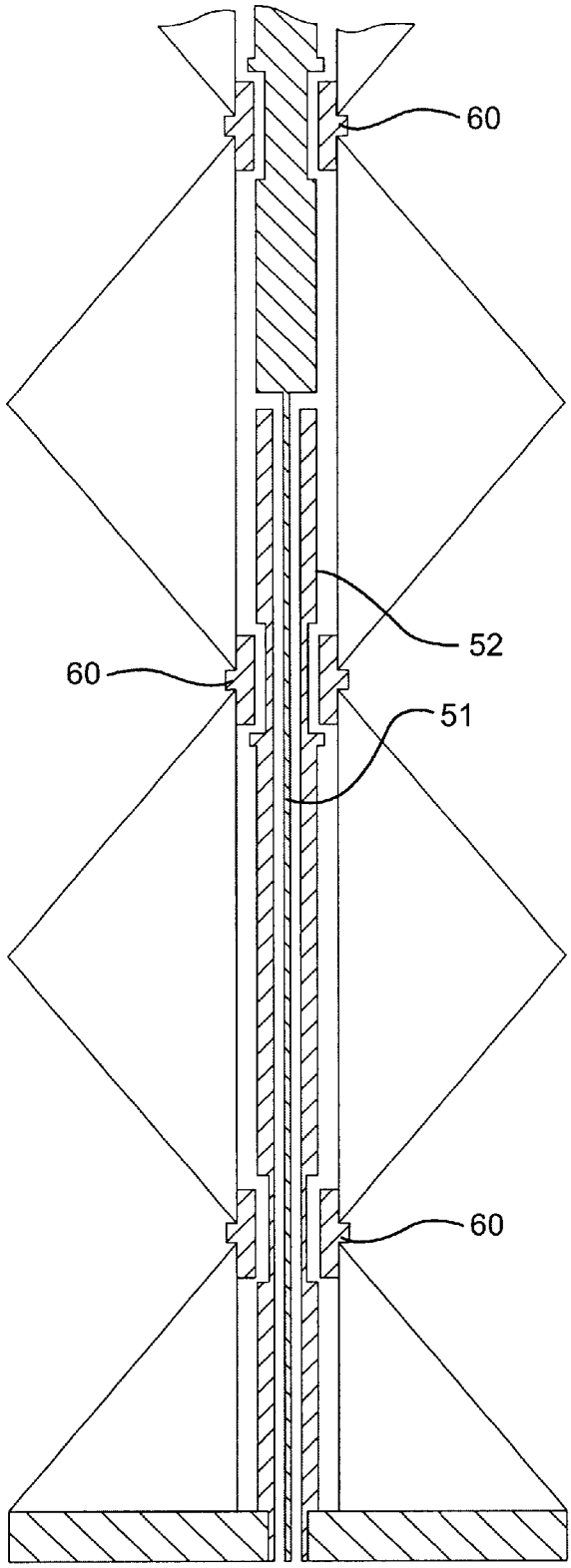
FIG. 5 is an enlarged side view of the bottom of the stacked substantially omnidirectional antenna, this particular embodiment includes four biconical array elements and a serial feed line.
Figure 6:
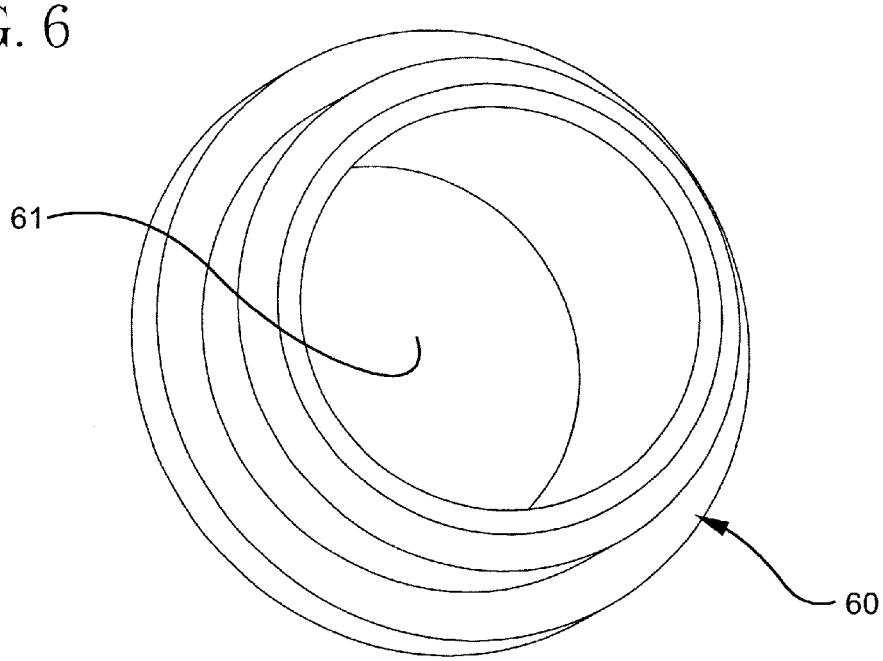
FIG. 6 is a top view of the connector (collar) of the biconical array elements to one another.
Figure 7:
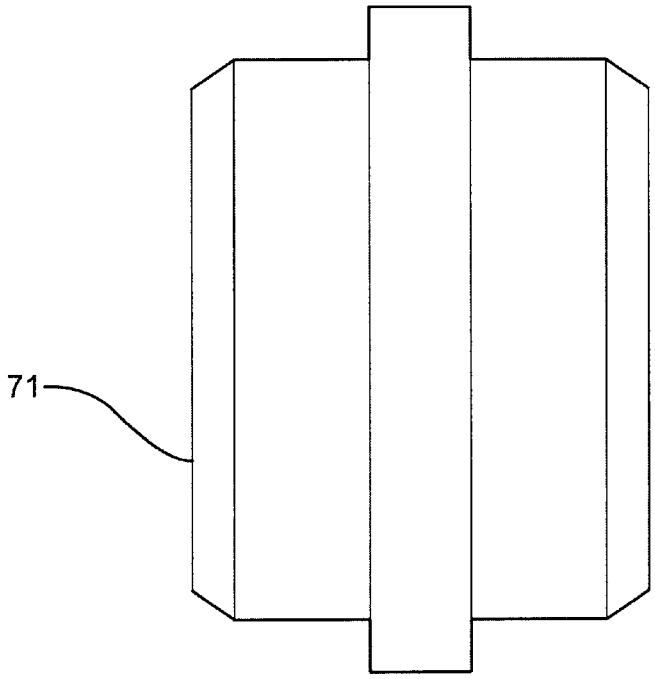
FIG. 7 is top view of the connector of the coaxial feed to the antenna.

In yet another embodiment, as illustrated in FIG. 4, the feed includes a parallel feed 41. The parallel feed provides the advantage of a beam that will not scan with frequency. A balanced feed is attained by the power traveling up though the center of the inner conductor 51, and having the power released in the middle of the bicones. The power then splits in two and travels up 42 and down 43 the biconical array elements. The impedance of the feed line after the 180 degree splitter (outer coax) 44 should be approximately half the impedance of the initial center coaxial feed line (inner coax) in order to achieve a good match. There exists a 180 degree phase difference between the two branches of the coax after the center feed. However, for the energy passing up through the top branch 45, the field is first incident on the bottom edge of the aperture. Conversely, for the energy passing vertically down the bottom branch 46, it is first incident to the top edge of the aperture. This causes a 180 degree phase shift at the bicone aperture which offsets the 180 degree shift at the center feed. Hence, the center feed needs to be in the center of the bicones, in this embodiment, in order to obtain an equal phase front for the azimuth beam.

In a further embodiment the collars may be made of a dielectric material other than ABS. Different materials with various dielectric constants may be used in order to allow different amounts of energy to be transmitted through each slot. Thus selection of dielectric for the collars can be used to help shape the transmitted beam.

The antenna may be hermetically sealed or enclosed in a radome. These enclosures advantageously protect the antenna from the weather and other elements. One advantage of the present invention is its ability to be constructed without the use of a radome for the structural support of the antenna. Instead, the bicones of the antenna are attached sturdily between the collars and held together by bolting, soldering, welding, or other connective means of the feed line to the antenna at the top and bottom of the stack of biconical array elements.

In another embodiment, the parallel and serial designs may be matched and the illumination modified by varying the distance between the top short and the outermost slot. This is simpler than tuning a taper or the radii of the inner conductor at the slots.

The operation of the substantially omnidirectional antenna 10 is as follows. In the transmit mode of operation, energy is supplied through the feed and transmitted to the biconical array of antennas in a series of steps. First, electromagnetic energy is passed through the feed line. Then the electromagnetic energy is emitted from the antenna through the slots. In one embodiment, the feed line is advantageously designed with a modulated impedance so that the first element couples 1/n of the incident power, the second coupling 1/(n−1) of the residual power and so forth until the $n^{th}$ element couples out the remaining power. The slots are spaced one guide wavelength apart to maintain phase coherence. The last element is one-half guide wavelength from the shorted end of the top of the feed line. Wave polarization is achieved by inducing a potential difference between the two edges of the slot. This potential difference gives rise to an electric field across the slot edges establishing the polarization of the radiated energy. In receive mode, the antenna works in the exact reverse manner as transmit mode.

The substantially omnidirectional antenna 10 of the present invention advantageously provides rotational symmetry such that the antenna pattern will be substantially uniform in a 360 degree azimuth circle surrounding the antenna. Unlike the prior art, the pattern is established substantially without interference. Thus the antenna radiates energy essentially equally in all directions due to its radial symmetry. The present invention creates a beam with 8–10 dBi gain with a variation of less than ±1 dB over the entire azimuth range over at least an entire band, for example, 5.2–5.9 Ghz. For a four-element array, the beam scan is only ±4 degrees over a 1 Ghz bandwidth.

In another embodiment, the antenna is able to transmit high power signals. This is achieved by increasing the power channeled through the feed line. The design of the antenna, unlike previous antenna designs, is able to function under these high power levels by incorporating thick metal into the antenna design. The thick metal and lack of sharp edges in the design allows for an antenna with power capabilities of several hundred watts.

The present invention provides a constant gain antenna over the 360 degree azimuth range with the further advantage of a reduced size antenna. Interference has been reduced over the prior art by removing the need for outside structural supports that interferes with the signal. Further, interference is reduced by placing the feed line through the center of the biconical antenna elements and collars. This improvement prevents the feed line from altering the beam after it is emitted from the antenna.

As can be seen, the antenna provides for both mechanical and electrical improvements over the prior art. It should be understood that various changes and modifications to the preferred embodiments described above will be apparent to those skilled in the art. Such apparent modifications fall within the scope of the following claims.

What is claimed is:

1. A substantially omnidirectional antenna comprising:

a plurality of stacked biconical antenna elements, wherein each of said biconical antenna elements is formed by a first cone and a second cone, said first cone and said second cone defining a truncated flared apart conducting surface, wherein said first cone and said second cone contain a bore perpendicular to the base of each of said first and second cones;

a plurality of nonconductive collars defining a bore, wherein each of said collars contains a top surface and a bottom surface, said top surface contacts said first cone and said bottom surface contacts said second cone; and a feed line element of a conductive material, said feed line element passing through each of said bores of said biconical antenna elements and each of said bores of said nonconductive collars, said feed line element having a plurality of different diameters alone its length.

2. The antenna of claim 1, wherein:

said plurality of biconical antenna elements are connected in an aligned stack, each of said elements containing an upper surface comprising the base of said first cone and a lower surface comprising the base of said second cone, said upper and said lower surfaces of adjacent antenna elements being attached at their outer circumference.

3. The antenna of claim 1, wherein:

each of said bottom surfaces of said nonconductive collars are in contact with the upper surface of said first cone of one of said biconical antenna element and each of said top surfaces of said nonconductive collars is in contact with said second cone of one of said biconical antenna element.

4. The antenna of claim 1, wherein:

said feed line element contains a first end and a second end, said feed line element inserted through said bores of said biconical antenna elements and through said bores of said nonconductive collars, said first of said feed line element attached to the conical base of the first end of said biconical antenna elements, and said second end of said feed line element connected to an electromagnetic energy power source.

5. The antenna of claim 1, wherein:

said plurality of biconical antenna elements comprises at least two biconical antenna elements.

6. The antenna of claim 1, wherein:

the biconical antenna elements are oriented so as to transmit and receive vertically polarized electromagnetic energy.

7. The antenna of claim 1, wherein:

an amount of electromagnetic energy radiating from one of said biconical antenna elements is substantially identical to an amount of electromagnetic energy radiating from another one of the biconical antenna elements.

8. The antenna of claim 1, wherein:

an amount of electromagnetic energy radiating from one of said biconical antenna elements differs from an amount of electromagnetic energy radiating from another one of the biconical antenna elements.

9. The antenna of claim 1, wherein:

said antenna is enclosed in a radome.

10. The antenna of claim 1, wherein:

said antenna is hermetically sealed.

11. The antenna of claim 1, further comprising:

means for mounting collars between biconical array elements.

12. The antenna of claim 1, wherein said feed line element is generally continuously tapered throughout its length.

13. A method for sending a substantially omnidirectional wireless communication signal via an antenna comprising:

sending electromagnetic current through a feed line element of conductive material, said feed line element having a plurality of different diameters as measured at discrete locations along a length of the feed line element; and passing said feed line element trough the center of a plurality of biconical antenna elements, each of said plurality of biconical antenna elements having a slot aperture proximate to one of the discrete locations of the feed line element.

14. The method of claim 13, wherein:

said feed line element having a tapered form.

15. A feed for a substantially omnidirectional biconical array antenna comprising:

a tapered non-cylindrical conductor engineered to deliver an amount of energy to each element of the antenna, said conductor passing through each element of the antenna, and said conductor having a plurality of different diameters along its length.

16. The feed of claim 15, wherein:

said coaxial conductor possesses a continuous taper.

17. A substantially omnidirectional antenna comprising:

a plurality of collinearly-aligned biconical antenna elements, each of the plurality of antenna elements having an associated slot aperture, each slot aperture having an associated height dimension;

a plurality of differently sized nonconductive collars, each collar being spaced between an associated pair of conductive antenna elements, wherein the heights of the slot apertures are substantially different; and a feed line element of conductive material, said feed line element having a plurality of different diameters measured along its length, said feed line conductor passing through each of said antenna elements and nonconductive collars.

* * * * *